US011701666B2

(12) United States Patent
Temores et al.

(10) Patent No.: US 11,701,666 B2
(45) Date of Patent: Jul. 18, 2023

(54) SUPPORT-RING AND GRINDING-RING WITH A RADIUSED INTERFACE

(71) Applicant: Schenck Process LLC, Kansas City, MO (US)

(72) Inventors: Jesus Temores, Chicago, IL (US); Michael M. Chen, Naperville, IL (US)

(73) Assignee: Schenck Process LLC, Kansas City, MO (US)

( * ) Notice: Subject to any disclaimer, the term of this patent is extended or adjusted under 35 U.S.C. 154(b) by 71 days.

(21) Appl. No.: 17/464,058

(22) Filed: Sep. 1, 2021

(65) Prior Publication Data

US 2023/0067068 A1 Mar. 2, 2023

(51) Int. Cl.
*B02C 15/00* (2006.01)

(52) U.S. Cl.
CPC ..... *B02C 15/003* (2013.01); *B02C 15/001* (2013.01)

(58) Field of Classification Search
CPC ..... B02C 15/00; B02C 15/003; B02C 15/02; B02C 15/001; B02C 15/04; B02C 15/045; B02C 15/06; B02C 15/081; B02C 15/123
USPC ..... 241/129, 131
See application file for complete search history.

(56) References Cited

U.S. PATENT DOCUMENTS

| | | | | | |
|---|---|---|---|---|---|
| 1,616,844 | A * | 2/1927 | Burke | B02C 15/02 | 464/132 |
| 1,706,254 | A * | 3/1929 | Rees | B02C 15/02 | 241/74 |
| 2,506,499 | A * | 5/1950 | Gibson | B02C 15/02 | 241/129 |
| 2,765,123 | A * | 10/1956 | Speer | B02C 15/02 | 241/58 |
| 2,876,955 | A * | 3/1959 | Clements | B02C 15/02 | 241/129 |
| 7,963,471 | B2 * | 6/2011 | Chen | B02C 15/02 | 241/129 |
| 2006/0022075 | A1 * | 2/2006 | Wark | B02C 15/001 | 241/119 |
| 2008/0102300 | A1 * | 5/2008 | Bhide | C04B 41/5144 | 428/545 |
| 2021/0283620 | A1 * | 9/2021 | Chen | B02C 23/24 | |

* cited by examiner

*Primary Examiner* — Shelley M Self
*Assistant Examiner* — Mohammed S. Alawadi
(74) *Attorney, Agent, or Firm* — Robinson & Cole LLP

(57) ABSTRACT

A base and ring assembly for a grinding mill includes a base structure with a support plate, an annular support-ring fixedly secured to and positioned above the support plate. The support-ring has a radially inward facing convex surface that extends from a support-ring lower axial end to a support-ring upper axial end. The assembly includes an annular grinding-ring that has a radially outward facing concave surface which extends from a grinding-ring lower axial end to a grinding-ring upper axial end. The grinding ring has a radially inward facing grinding surface. The radially outward facing concave surface is complementary in shape to and engages the radially inward facing convex surface.

12 Claims, 6 Drawing Sheets

SUPPORT-RING AND GRINDING-RING WITH A RADIUSED INTERFACE

TECHNICAL FIELD

The present disclosure relates generally to a base and ring assembly for a grinding mill that has a support-ring and grinding-ring that have a radiused interface that inhibits binding of the grinding-ring in the support-ring and reduces vertical drop of the grinding-ring relative to the support-ring.

BACKGROUND

Grinding mills are used to crush and pulverize solid materials such as minerals, limestone, gypsum, phosphate rock, salt, coke, and coal into small particles. Pendulum roller mills and planetary mills are examples of typical grinding mills that can be used to crush and pulverize the solid materials. The grinding mills can be mounted to a foundation. The grinding section can include a plurality of crushing members such as rollers that moveably engage a grinding surface of a grinding ring. The crushing members are in operable communication with a driver, such as a motor, which imparts a rotary motion on the crushing members. During operation of the grinding mill, pressurizing, gravitational or centrifugal forces drive the crushing members against the grinding surface. The crushing members pulverize the solid material against the grinding surface as a result of contact with the grinding surface of the grinding ring.

The grinding mills generally include a grinding section disposed inside a housing. As shown in FIG. 5, the grinding section of prior art grinding mills includes a support ring 1030 that has a straight inside conical surface 1032 that is inclined at an angle θ of about 5 degrees relative to a vertical reference line. The prior art grinding mills include a grinding ring 1040 that has a straight outside conical surface 1042 that is inclined at an angle θ of about 5 degrees relative to a vertical reference line. The prior art grinding ring 1040 is wedged into the support ring 1030. The prior art grinding rings 1040 tend to drop vertically a distance (i.e., vertical drop DP) with respect to the support ring 1030 after installation in the support ring 1030. The drop is caused by the weight of the grinding ring 1030, vibrations, cyclic heating and cooling and the conical interface between the grinding ring 1030 and the support ring 1040. The vertical drop of the grinding ring 1030 causes a misalignment of the grinding surface with the crushing members and causes the grinding ring 1040 to be wedged into the support ring 1030 making it very difficult to remove. When the prior art support ring 1030 and grinding ring 1040 are heated up to operating temperatures of about 399 degrees Celsius (750 degrees Fahrenheit) the grinding ring 1040 vertically drops relative to the support ring 1030. When the prior art support ring 1030 and grinding ring 1040 are cooled to ambient temperature after such heating, the grinding ring 1040 does not raise or lift back up relative to the support ring 1030. Instead, the grinding ring 1040 remains wedged in the support ring 1030.

Thus, there is a need for an improved grinding mill that overcomes the foregoing problems.

SUMMARY

According to aspects illustrated herein, there is provided a base and ring assembly for a grinding mill. The assembly includes a base structure with a support plate configured to be fixedly secured to a foundation. The assembly includes an annular support-ring fixedly secured to and positioned above the support plate. The support-ring has a radially inward facing convex surface that extends from a support-ring lower axial end to a support-ring upper axial end. The assembly includes an annular grinding-ring that has a radially outward facing concave surface that extends from a grinding-ring lower axial end to a grinding-ring upper axial end. The grinding-ring has a radially inward facing grinding surface. The radially outward facing concave surface is complementary in shape to and engages the radially inward facing convex surface.

In some embodiments, engagement of the radially outward facing concave surface with the radially inward facing convex surface is configured to mitigate binding of the grinding-ring with the support-ring and to mitigate vertical displacement of the grinding-ring relative to the support-ring. The radially outward facing concave surface and the radially inward facing convex surface cooperate with one another to form an anti-binding feature that prevents the grinding-ring to becoming wedged in the support-ring. The radially outward facing concave surface and the radially inward facing convex surface cooperate with one another to form a drop mitigation feature that limits vertical drop measured between the grinding-ring upper axial end and the support-ring upper axial end. The support-ring has a support-ring upper segment and the grinding-ring has a grinding-ring upper segment. The support-ring upper segment is a shoulder that abuts the grinding-ring upper segment to inhibit binding of the grinding-ring in the support-ring.

In some embodiments, the grinding-ring has an inside diameter and an axial height. The radially outward facing concave surface and/or the radially inward facing convex surface one or more radius of curvatures which are greater than the axial height and less than four times the inside diameter.

In some embodiments, the grinding-ring has an axial height and the radially outward facing concave surface and/or the radially inward facing convex surface one or more radius of curvatures measured from an origin point located radially outward from the support-ring. A horizontal line that passes through the origin point is located a vertical distance below the grinding-ring lower axial end and the distance is greater than zero and less than the axial height.

In some embodiments, when the support-ring and the grinding-ring are heated to 399 degrees Celsius (750 degrees Fahrenheit) and subsequently cooled to ambient temperature, the grinding ring returns to a vertical position that is substantially the same as an initial vertical of the grinding ring relative to the support ring, position prior to heating.

In some embodiments, one or more of the radially outward facing concave surface and the radially inward facing convex surface have two or more radii of curvature.

In some embodiments, a plurality of vertical vanes are joined to and separate the support plate and the support-ring, thereby forming an air intake passage.

In some embodiments, the support-ring and/or the grinding-ring are manufactured from a cast or forged high chromium steel alloy.

In one embodiments, the radially inward facing grinding surface has a straight cylindrical contour. In one embodiment, the radially inward facing grinding surface has a concave contour.

The present invention includes a grinding mill that has a shaft configured for rotation about a longitudinal axis of the shaft. The shaft has a radially outward extending support structure in communication therewith. A plurality of crushing elements (e.g., rollers) are operably connected to the support structure and configured to rotate with the shaft. The grinding mill includes a base and ring assembly. The assembly includes a base structure with a support plate configured to be fixedly secured to a foundation. The assembly includes an annular support-ring fixedly secured to and positioned above the support plate. The support-ring has a radially inward facing convex surface that extends from a support-ring lower axial end to a support-ring upper axial end. The assembly includes an annular grinding-ring that has a radially outward facing concave surface that extends from a grinding-ring lower axial end to a grinding-ring upper axial end. The grinding-ring has a radially inward facing grinding surface. The radially outward facing concave surface is complementary in shape to and engages the radially inward facing convex surface. The crushing elements rollingly engage the radially inward facing grinding surface.

The present invention includes a method of using a base and ring assembly for a grinding mill. The method includes providing the base and ring assembly that includes a base structure with a support plate configured to be fixedly secured to a foundation. The assembly includes an annular support-ring fixedly secured to and positioned above the support plate. The support-ring has a radially inward facing convex surface that extends from a support-ring lower axial end to a support-ring upper axial end. The assembly includes an annular grinding-ring that has a radially outward facing concave surface that extends from a grinding-ring lower axial end to a grinding-ring upper axial end. The grinding-ring has a radially inward facing grinding surface. The radially outward facing concave surface is complementary in shape to and engages the radially inward facing convex surface. The method includes positioning the grinding ring in the support ring at ambient temperature so that the grinding ring is at an initial vertical position relative to the support ring. The grinding-ring while installed in the support-ring is heated to about 399 degrees Celsius (750 degrees Fahrenheit) or higher temperatures, for example, up to about 510 degrees Celsius (950 degrees Fahrenheit). Subsequent to heating, the grinding ring while installed in the support ring is cooled to ambient temperature. The method includes automatically returning the grinding ring to substantially the same initial vertical position relative to the support ring.

Any of the foregoing embodiments may be combined.

BRIEF DESCRIPTION OF THE DRAWING

Referring now to the Figures, which are exemplary embodiments, and wherein the like elements are numbered alike.

DETAILED DESCRIPTION

Figure 9:
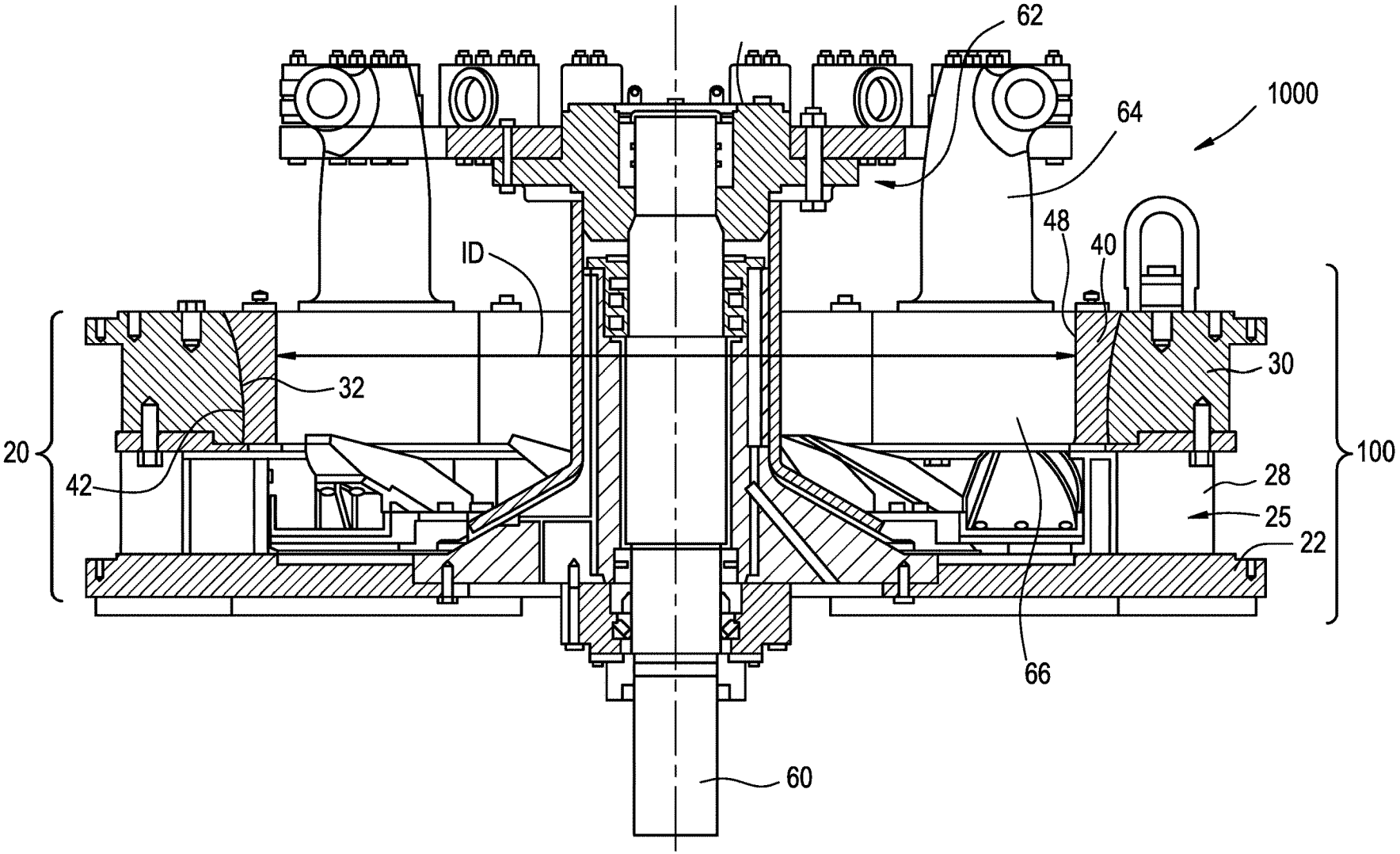
FIG. 9 is a cross sectional view of a grinding section of a pendulum mill having the support ring and grinding ring of the present invention.

As shown in FIG. 9 a grinding section of a pendulum mill is generally designated by element number 1000. The grinding section 1000 includes a rotatable shaft 60 that has a radially outward extending support structure 62 (e.g., a plurality of support arms) in communication with (i.e., secured to) the shaft 60. The shaft 60 is bearing mounted in a substantially vertical orientation. Each of the support arms 62 has a pendulum arm 64 pivotally connected thereto. Each of the pendulum arms 64 has a crushing element 66 (e.g., a roller) rotationally mounted thereon. The grinding section 1000 includes a base and ring assembly 100 that includes a grinding-ring 40 that has a radially inward facing grinding surface 48 which has a straight cylindrical contour. The radially inward facing grinding surface 48 has an inside diameter ID. Each of the crushing elements 66 rollingly engage the radially inward facing grinding surface 48 to grind (e.g., pulverize) material such as minerals, limestone, gypsum, phosphate rock, salt, coke, coal that is fed through the grinding section 1000.

Figure 10:
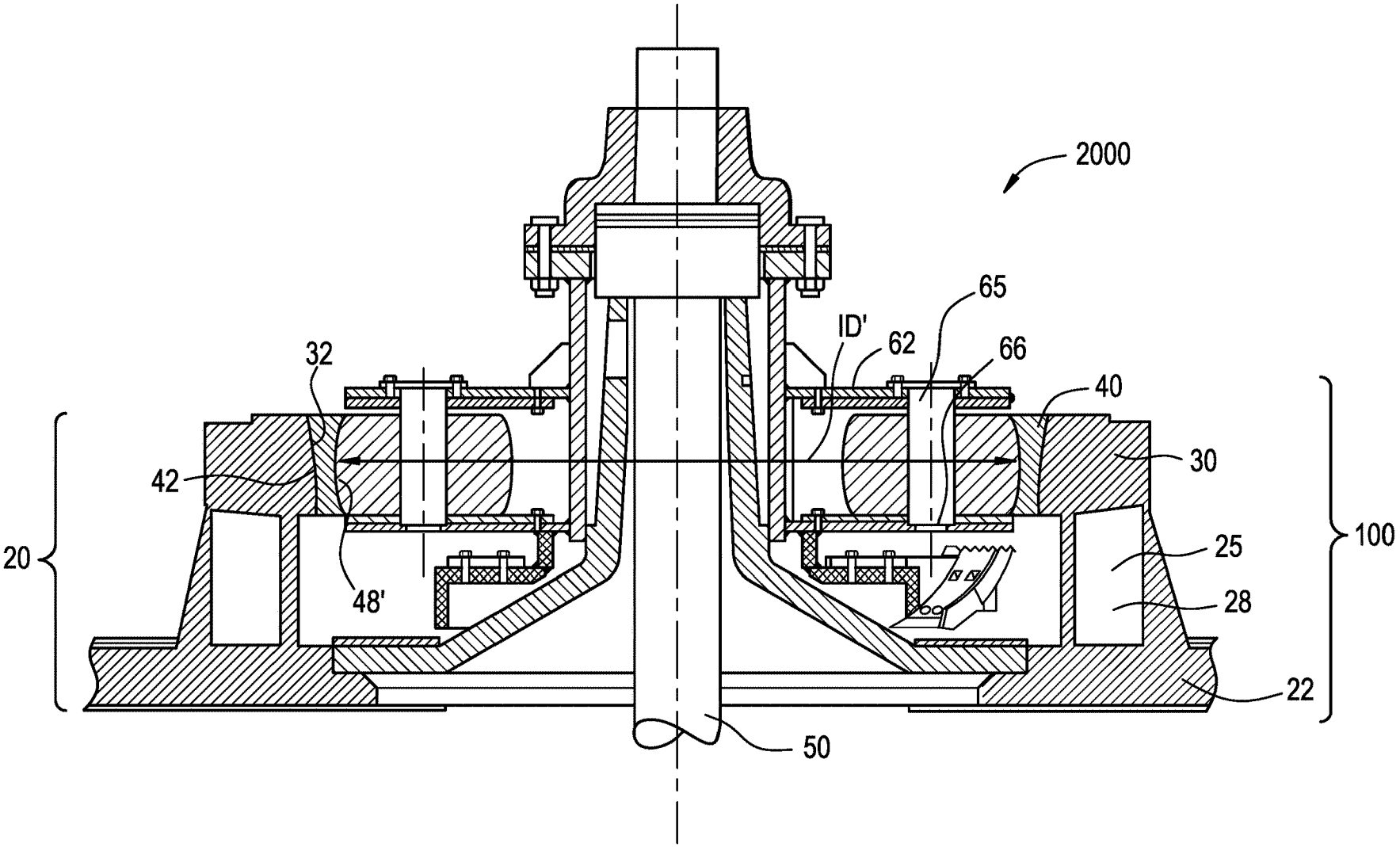
FIG. 10 is a cross sectional view of a grinding section of a planetary mill having the support ring and grinding ring of the present invention.

As shown in FIG. 10 a grinding section of a planetary mill is generally designated by element number 2000. The grinding section 2000 includes a rotatable shaft 60 that has a radially outward extending support structure 62 (e.g., a plurality of support plates) in communication with (i.e., secured to) the shaft 60. The shaft 50 is bearing mounted in a substantially vertical orientation. Each of the support plates 62 has a plurality of mounting shafts 65 secured thereto. Each of the mounting shafts 65 has a crushing element 66 (e.g., a roller) rotationally mounted thereon. The grinding section 2000 includes a base and ring assembly 100 that includes a grinding-ring 40 that has a radially inward facing grinding surface 48' which has a concave contour. The radially inward facing grinding surface 48' has an inside diameter ID' that is measured at the apex of the concave contour to obtain the maximum inside diameter of the radially inward facing grinding surface 48'. Each of the crushing elements 66 rollingly engage the radially inward facing grinding surface 48' to grind (e.g., pulverize) material such as minerals, limestone, gypsum, phosphate rock, salt, coke and coal that is fed through the grinding section 2000.

Figure 1:
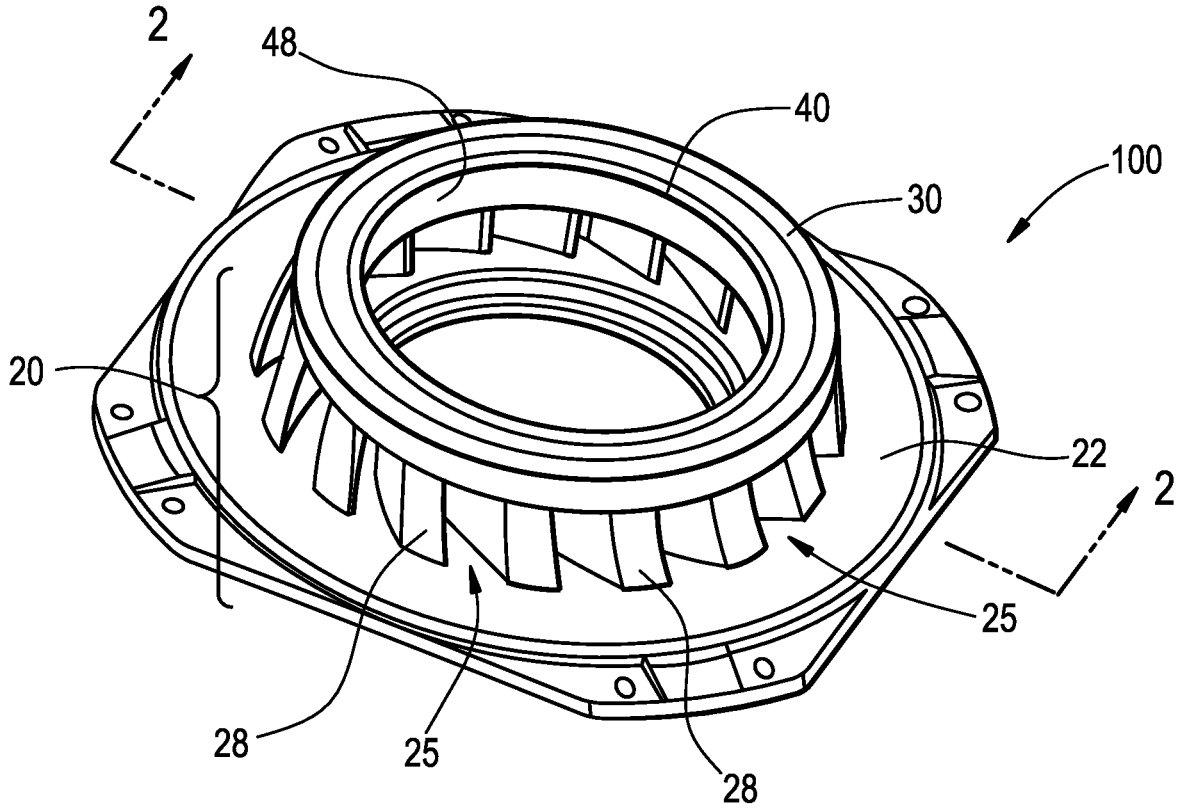
FIG. 1 is a perspective view of a grinding mill base and ring assembly of the present invention.
Figure 2:
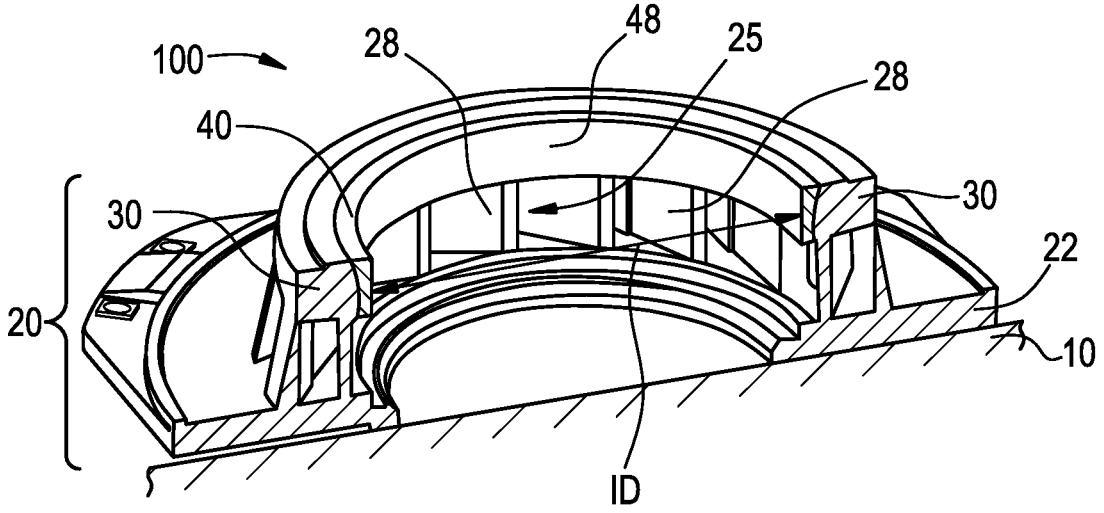
FIG. 2 is cross sectional perspective view of the grinding mill base and ring of FIG. 1 taken across section 2-2.
Figure 3:
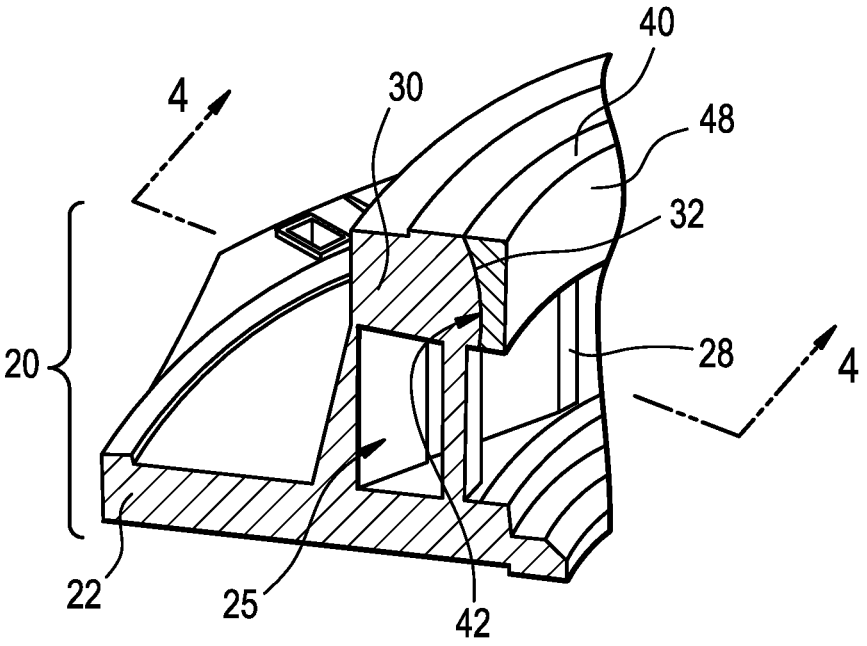
FIG. 3 is an enlarged cross sectional perspective view of a portion of the grinding mill base and ring assembly of FIG. 2.

As best shown in FIGS. 1-3, the base and ring assembly 100 includes a base structure 20 that has a support plate 22 configured to be fixedly secured to a foundation 10 (see FIG. 2). An annular support-ring 30 fixedly secured to and positioned vertically above the support plate 22 and separated therefrom by an air intake passage 25. A plurality of vanes 28 are joined (e.g., integrally formed in a casting) to the support plate 22 and the support-ring 30. The support-ring 30 is manufactured from a cast or forged high chromium steel alloy.

Figure 4:
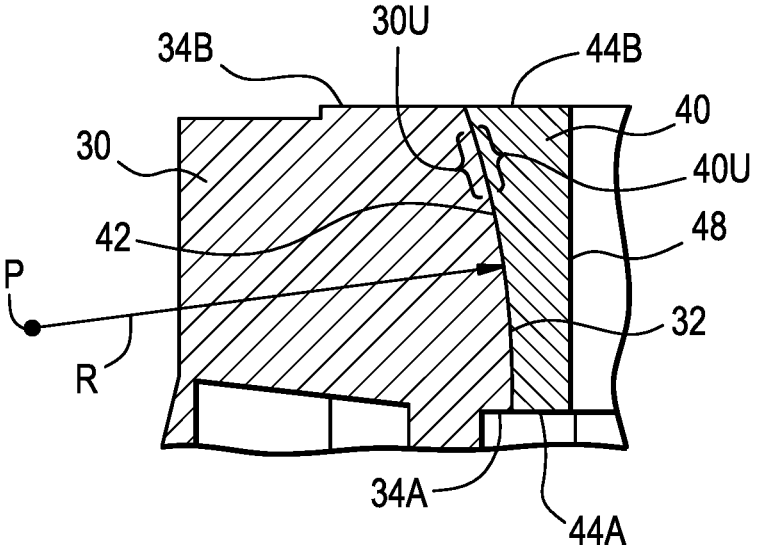
FIG. 4 is a cross sectional view of the grinding mill base and ring assembly of FIG. 3 taken across section 4-4.
Figure 5:
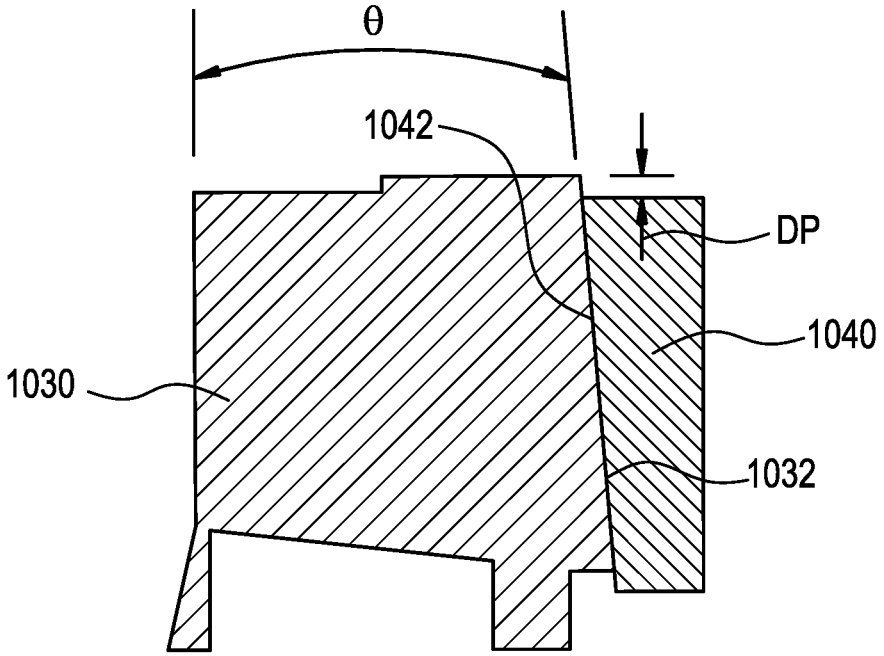
FIG. 5 PRIOR ART
FIG. 5 is a cross sectional view of a prior art grinding mill base and ring assembly.

As shown in FIG. 4, the support-ring 30 has a radially inward facing convex surface 32 that extends from a support-ring lower axial end 34A to a support-ring upper axial end 34B.

As shown in FIGS. 1 and 4, the base and ring assembly 100 includes an annular grinding-ring 40 that has a radially outward facing concave surface 42 that extends from a grinding-ring lower axial end 44A to a grinding-ring upper axial end 44B. The grinding-ring 40 is disposed radially inward from the support-ring 30. The radially outward facing concave surface 42 is complementary in shape to and engages at least a portion of the radially inward facing convex surface 32 thereby establishing a radiused interface. The grinding-ring 40 is manufactured from a cast or forged high chromium steel alloy.

The engagement of the radially outward facing concave surface 42 with the radially inward facing convex surface 32 is configured to mitigate binding of the grinding-ring 40 with the support-ring 30 and to mitigate vertical displacement of the grinding-ring 40 relative to the support-ring 30. The radially outward facing concave surface 42 and the radially inward facing convex surface 32 cooperate with one another to form an anti-binding feature that prevents the grinding-ring 40 to become wedged in the support-ring 30. The radially outward facing concave surface 42 and the radially inward facing convex surface 32 cooperate with one another to form a drop mitigation feature that limits vertical drop measured between the grinding-ring upper axial end 44B and the support-ring upper axial end 34B.

As shown in FIG. 4 the support-ring 30 has a support-ring upper segment 30U and the grinding-ring 40 has a grinding-ring upper segment 40U. The support-ring upper segment 30U is a shoulder that abuts the grinding-ring upper segment 40U to inhibit binding of the grinding-ring 40 in the support-ring 30.

Figure 7:
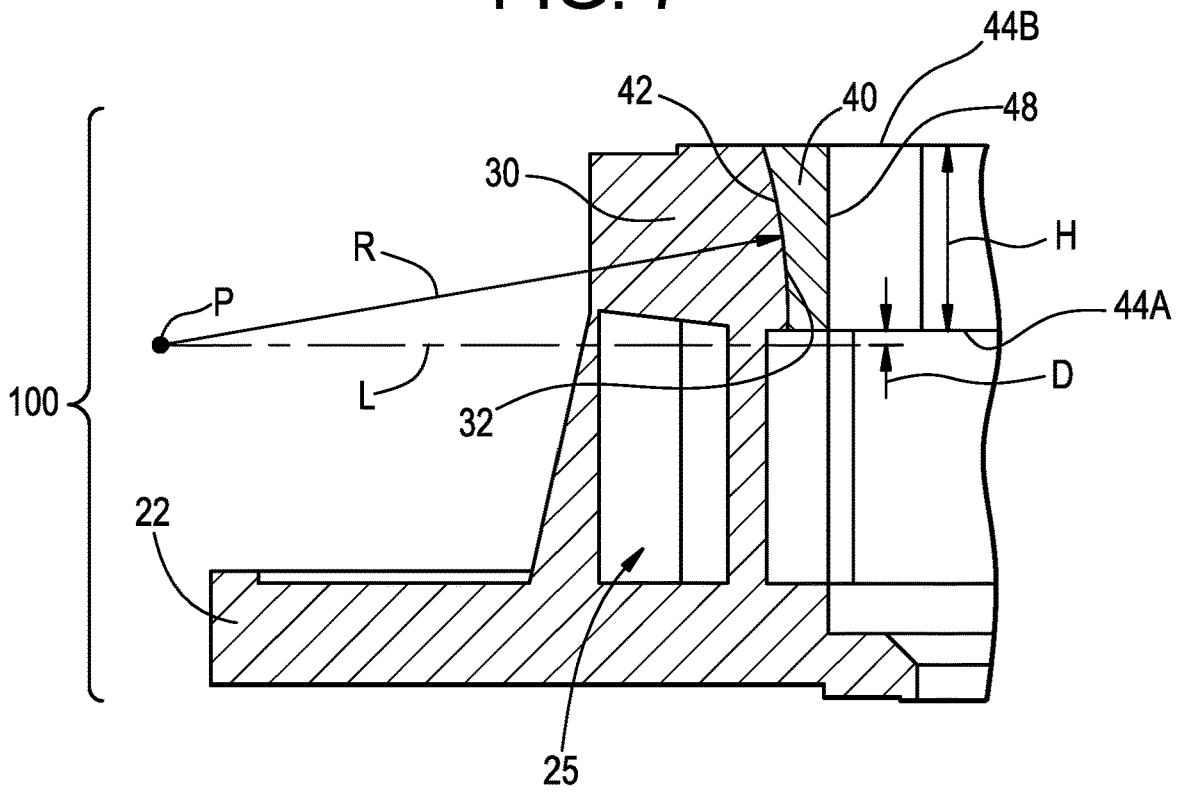
FIG. 7 is a schematic illustration of the grinding mill base and ring assembly of FIG. 4 for a pendulum mill.

As shown in FIG. 7, the grinding-ring 40 of the base and ring assembly 100 has an inside diameter ID (see FIG. 9 for ID) and an axial height H. The radially outward facing concave surface 42 and the radially inward facing convex surface 32 has a radius of curvature R. The radially inward facing convex surface 32 has the same radius of curvature R as the radially outward facing concave surface 42. The radius of curvature R is greater than the axial height H and less than four times the inside diameter ID (e.g., 30 to 120 inch, 76 to 305 cm inside diameter).

In some embodiments, the radially outward facing concave surface 42 and the radially inward facing convex surface 32 have a radius of curvature of 76.2 to 101.6 centimeters (30 to 40 inches). In some embodiments, the radially outward facing concave surface 42 and the radially inward facing convex surface 32 has a radius of curvature of 90.4 centimeters (35.6 inches).

While the radially outward facing concave surface 42 and the radially inward facing convex surface 32 are shown and described as each having the radius of curvature R, the present invention is not limited in this regard as the radially outward facing concave surface 42 and the radially inward facing convex surface 32 may have a first radius of curvature along a respective first portion thereof, a second radius of curvature along a second respective portion thereof and/or a third radius of curvature along a third respective portion thereof.

As shown in FIG. 7, the radius of curvature R is measured from an origin point P that is located radially outwardly from the support ring 30. A horizontal line L passes through the origin point P and is located a vertical distance D below the grinding-ring lower axial end 44A. The distance D is greater than zero and less than the axial height H.

Figure 8:
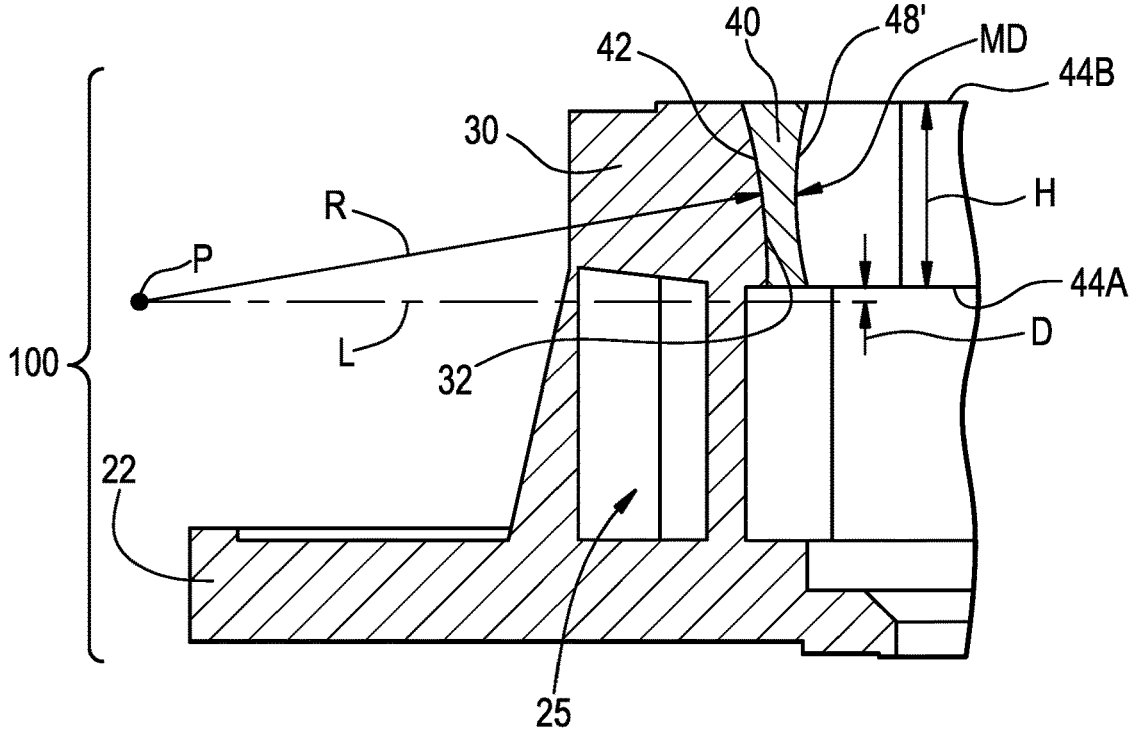
FIG. 8 is a schematic illustration of a grinding mill base and ring assembly of FIG. 4 for a planetary mill.

The base and ring assembly 100 of FIG. 8 is similar to the base and ring assembly 100 of FIG. 7 except that the radially inward facing grinding surface 48' has a concave contour and the inside diameter is designated by ID' and is measured at the apex of the concave contour so that the inside diameter ID' is the maximum inside diameter of the radially inward facing grinding surface 48'. Thus, the grinding-ring 40 of the base and ring assembly 100 has an inside diameter ID' and an axial height H. The radially outward facing concave surface 42 and the radially inward facing convex surface 32 has a radius of curvature R. The radially inward facing convex surface 32 has the same radius of curvature R as does the radially outward facing concave surface 42. The radius of curvature R is greater than the axial height H and less than four times the inside diameter ID'.

As shown in FIG. 8, the radius of curvature R is measured from an origin point P that is located radially outwardly from the support ring 30. A horizontal line L passes through the origin point P and is located a vertical distance D below the grinding-ring lower axial end 44A. The distance D is greater than zero and less than the axial height H.

Figure 6:
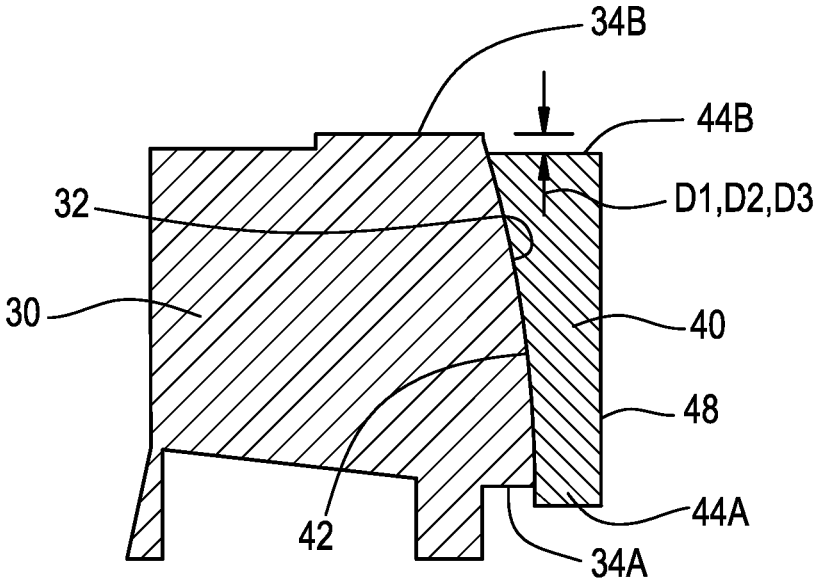
FIG. 6 is a schematic illustration of the grinding mill base and ring assembly of FIG. 4 showing vertical drop of the grinding ring.

Referring to FIG. 6, at ambient temperature (e.g., 20 to 26.7 degrees Celsius; 68 to 80 degrees Fahrenheit) the grinding-ring upper axial end 44B is located vertically below the support-ring upper axial end 34B by a first drop-distance D1 and after heating the support-ring 30 and the grinding-ring 40 above ambient temperature and subsequently cooling down to ambient temperature, the grinding-ring upper axial end 44B is located vertically below the support-ring upper axial end 34B by a third drop-distance D3 that is substantially equal to (e.g., within 0.25 inches, preferably within 0.10 inches and more preferably within 0.05 inches, of the first drop distance D1) the first drop distance D1.

Referring to FIG. 6, finite element analysis (FEA) for one grinding ring size (i.e., 66 inch, 168 cm diameter) predicted that when the grinding-ring 40 is initially installed in the support-ring 30 and at ambient temperature as defined herein, the grinding-ring 40 drops vertically a first drop-distance D1 measured from the support-ring upper axial end 34B to the grinding-ring upper axial end 44B. The FEA predicted that for the 66 inch diameter grinding ring, that the first drop-distance D1 is less than or equal to 0.16 centimeters (0.063 inches). While the FEA was performed for a 66 inch diameter mill size, the FEA concepts and conclusions that grinding ring 40 returns to substantially the same vertical position relative to the support ring 30, after heating and subsequent cooling, are generally applicable to 30 to 120 inch (76 to 305 cm) diameter mill sizes.

Referring to FIG. 6, the FEA predicted that after the grinding-ring 40 is initially installed in the support-ring 30 and when the grinding-ring 40 and the support-ring 30 are heated to a temperature 399 Celsius (750 degrees Fahrenheit), the grinding-ring 40 drops vertically a second drop-distance D2 measured from the support-ring upper axial end 34B to the grinding-ring upper axial end 44B. The FEA predicted that the second drop-distance D2 is less than or equal to 0.366 centimeters (0.144 inches).

Referring to FIG. 6, the FEA predicted that after the grinding-ring 40 is initially installed in the support-ring 30 and when cooled down to ambient temperature, as defined herein, after heating the grinding-ring 40 and the support-ring 30 to a temperature of 399 Celsius (750 degrees Fahrenheit), the grinding-ring 40 is located vertically a third drop-distance D3 measured from the support-ring upper axial end 34B to the grinding-ring upper axial end 44B. The FEA predicted that the third drop-distance D3 is less than or equal to 0.130 centimeters (0.051 inches).

The present invention includes method of using the base and ring assembly 100 for a grinding mill 1000, 2000. The method includes providing the base and ring assembly 100. The method includes positioning the grinding ring 40 in the support ring 30 at ambient temperature so that the grinding ring 40 is at an initial vertical position relative to the support ring 30. The grinding ring 40, while installed in the support-ring 30, is heated to about 399 degrees Celsius (750 degrees Fahrenheit) or high temperatures, for example, up to about 510 degrees Celsius (950 degrees Fahrenheit). Subsequent to heating, the grinding ring 40 while installed in the support ring 30, is cooled to ambient temperature. After the cooling the grinding ring 40 is automatically (e.g., without the assistance of external forces applied to the grinding ring 40) returned to substantially the same (e.g., within 0.25 inches, preferably within 0.10 inches and more preferably within 0.05 inches of the initial vertical position) initial vertical position relative to the support ring 30.

While the present disclosure has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A base and ring assembly for a grinding mill, the assembly comprising:

a base structure comprising a support plate configured to be fixedly secured to a foundation, an annular support-ring fixedly secured to and positioned above the support plate, the annular support-ring having a radially inward facing convex surface extending from a support-ring lower axial end to a support-ring upper axial end; and an annular grinding-ring having a radially outward facing concave surface extending from a grinding-ring lower axial end to a grinding-ring upper axial end, the annular grinding-ring having a radially inward facing grinding surface, the radially outward facing concave surface being complementary in shape to and engaging at least a portion of the radially inward facing convex surface.

2. The assembly of claim 1, wherein engagement of the radially outward facing concave surface with the at least a portion of the radially inward facing convex surface is configured to mitigate binding of the annular grinding-ring with the annular support-ring and to mitigate vertical displacement of the annular grinding-ring relative to the annular support-ring.

3. The assembly of claim 1, wherein the radially outward facing concave surface and the radially inward facing convex surface cooperate with one another to form an anti-binding feature that prevents the annular grinding-ring to becoming wedged in the annular support-ring.

4. The assembly of claim 1, wherein the radially outward facing concave surface and the radially inward facing convex surface cooperate with one another to form a drop mitigation feature that limits vertical drop measured between the grinding-ring upper axial end and the support-ring upper axial end.

5. The assembly of claim 1, wherein the annular support-ring has a support-ring upper segment and the annular grinding-ring has a grinding-ring upper segment, wherein the support-ring upper segment is a shoulder that abuts the grinding-ring upper segment to inhibit binding of the annular grinding-ring in the annular support-ring.

6. The assembly of claim 1, wherein the annular grinding-ring has an inside diameter and an axial height and at least one of the radially outward facing concave surface and the radially inward facing convex surface has at least one radius of curvature; and wherein the at least one radius of curvature is greater than the axial height and less than four times the inside diameter.

7. The assembly of claim 1, wherein the annular grinding-ring has an axial height and at least one of the radially outward facing concave surface and the radially inward facing convex surface has at least one radius of curvature measured from an origin point located radially outward from the annular support-ring;

wherein a horizontal line passing through the origin point is located a vertical distance below the grinding-ring lower axial end; and wherein the distance is greater than zero and less than the axial height.

8. The assembly of claim 1, wherein at least one of the radially outward facing concave surface and the radially inward facing convex surface have at least two radii of curvature.

9. The assembly of claim 1, further comprising a plurality of vertical vanes that are joined to and separate the support plate and the annular support-ring, thereby forming an air intake passage.

10. The assembly of claim 1, wherein at least one of the annular support-ring and the annular grinding-ring comprise a cast or forged high chromium steel alloy.

11. The assembly of claim 1, wherein the radially inward facing grinding surface has one of a straight cylindrical contour and a concave contour.

12. A grinding mill comprising:

a shaft configured for rotation about a longitudinal axis of the shaft, the shaft having a radially outward extending support structure in communication therewith;

a plurality of crushing elements operably connected to the support structure and configured to rotate with the shaft; and the base and ring assembly of claim 1, wherein the crushing elements rollingly engage the radially inward facing grinding surface.

* * * * *